United States Patent [19]

Takagi et al.

[11] 4,308,437

[45] Dec. 29, 1981

[54] HANDLE OPERATING MECHANISM FOR AN ELECTRIC CIRCUIT BREAKER

[75] Inventors: Masatomi Takagi, Hachioji; Takanori Hagawa, Oume; Seietsu Takamatsu, Hamura; Isao Ookoshi, Tama, all of Japan

[73] Assignee: Tokyo Shibaura Denki Kabushiki Kaisha, Kawasaki, Japan

[21] Appl. No.: 90,054

[22] Filed: Oct. 31, 1979

[30] Foreign Application Priority Data

Jan. 23, 1979 [JP] Japan ..... 54/5555

[51] Int. Cl.[3] ..... H01H 9/20

[52] U.S. Cl. ..... 200/50 A; 200/153 LB

[58] Field of Search ..... 200/50 A, 50 R, 155 A, 200/153 LB

[56] References Cited

U.S. PATENT DOCUMENTS 3,192,334 6/1965 Diamond et al. ..... 200/50 A
3,260,808 7/1966 Diamond et al. ..... 200/42

FOREIGN PATENT DOCUMENTS 45-3239 5/1970 Japan ..... 200/50 A
45-11125 5/1970 Japan ..... 200/50 A

*Primary Examiner*—J. V. Truhe
*Assistant Examiner*—Morris Ginsburg
*Attorney, Agent, or Firm*—Oblon, Fisher, Spivak, McClelland & Maier

[57] ABSTRACT

A handle operating mechanism is provided to actuate an electric circuit breaker having a release lever and to interlock the electric circuit breaker and the door of a casing accommodating the circuit breaker. A manually operable handle is rotatably mounted on a case and is integrally coupled with a cam, disposed within the case, having a pin and a trapped portion. An actuating member which is engaged with the pin of the cam is linearly moved along a guide rod in response to rotation of the handle. One end of the guide rod contacts and slides along the circumference of the cam, the other end of the guide rod extending from the case to interlock with the door of the casing.

14 Claims, 17 Drawing Figures

HANDLE OPERATING MECHANISM FOR AN ELECTRIC CIRCUIT BREAKER

BACKGROUND OF THE INVENTION

1. Field of the Invention

This invention generally relates to a handle operating mechanism adapted to a circuit breaker which is built in a control center or a sealed switch board.

2. Description of the Prior Art

There are known electric circuit breakers of a type including a toggle type operating member and a rotary or twist type manually engageable handle member connected to the toggle type operating member by an adapting mechanism.

Generally, it is necessary to keep and lock the control center or the sealed switch board under a certain condition in order to prevent dangerous accidents from occurring. Namely, the control center is required to interlock the relationship between the operation of the circuit breaker and the open-close position of the door which covers the circuit breaker. Accordingly, the door cannot open because of the interlocking mentioned above when the circuit breaker, for example, is positioned in the ON state.

Such a prior handle operating mechanism for use with the circuit breaker is disclosed in, for example, U.S. Pat. 3,192,334 issued on June 29, 1965. In this prior art the interlocking mechanism attached to the handle operating means is engaged with a catch provided behind the door by depressing the door, whereby the operation of the handle operating mechanism can be carried out.

However, there are cases of insufficient interlocking which can occur between the operation of the circuit breaker and the door due to depressing the door with too great or too little force because of warping of the door or improper attachment of the door catch. Therefore the interlock mechanism can not be operated under such circumstances. Accordingly, an extensive amount of time for adjustment of the interlock mechanism is required.

SUMMARY OF THE INVENTION

Accordingly, it is an object of this invention to provide a new and improved unique handle operating mechanism which can be manufactured without complicated adjustment of the interlock mechanism, and provides the desired locking and interlocking function.

Briefly, in accordance with one aspect of this invention, a handle operating mechanism is provided which includes an electric circuit breaker having an operating lever with the handle operating mechanism interlocking the electric circuit breaker and a door of a casing accommodating the circuit breaker with the handle operating mechanism including a case disposed within the casing, a release lever for the circuit breaker mounted within the case, a manually operable handle rotatably mounted on a surface on a surface of the case for predetermined operating positions including an ON position and TRIP position, a mechanism connected to the operable handle for actuating the release lever for the circuit breaker upon movement of the operatable handle, and a mechanism for engaging the case with the door of the casing so as to interlock the case and the door when the operable handle is placed at the ON and TRIP positions.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
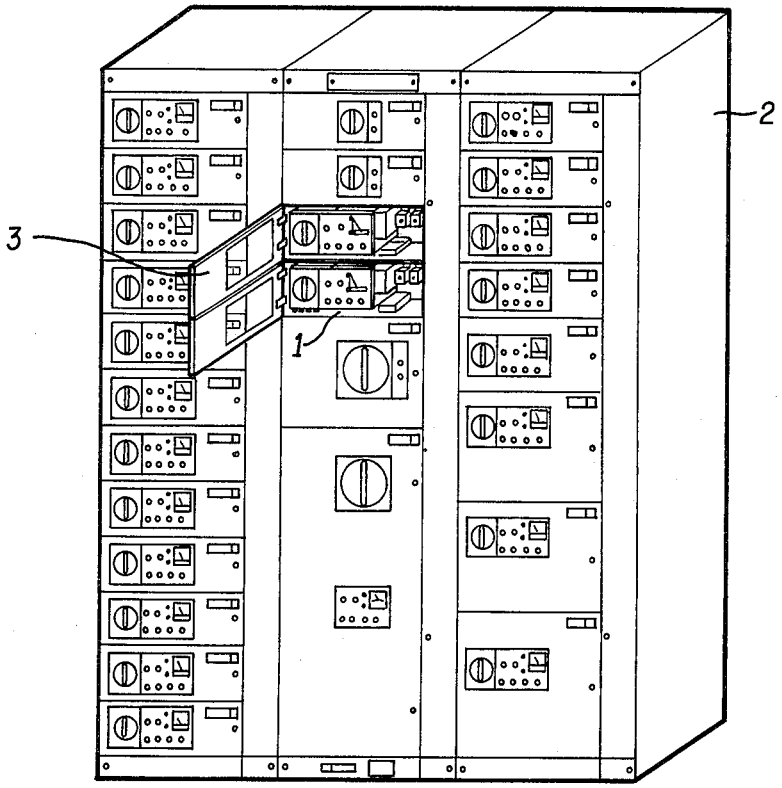
FIG. 1 is a perspective view of a control center for use with a handle operating mechanism according to this invention.

Referring now to the drawings, and more particularly to FIG. 1 thereof, a plurality of unit devices 1 are shown which include electrical instruments, for example, a molded case circuit breaker having an operating lever, a manually operable handle for actuating the lever of the circuit breaker, a control-changeover switch, meter instruments, an electromagnetic switch and relay, etc. accommodated in a casing 2.

The unit device 1 is formed to interlock with a door 3 which covers each unit device 1.

Figure 2:
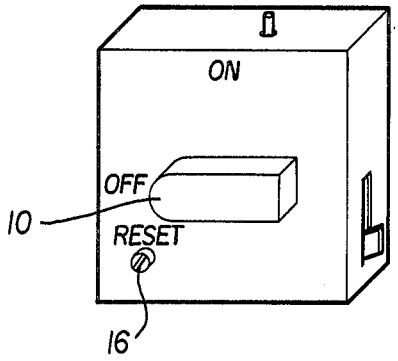
FIG. 2 is a front plan perspective view of a handle operating mechanism according to this invention.
Figure 3:
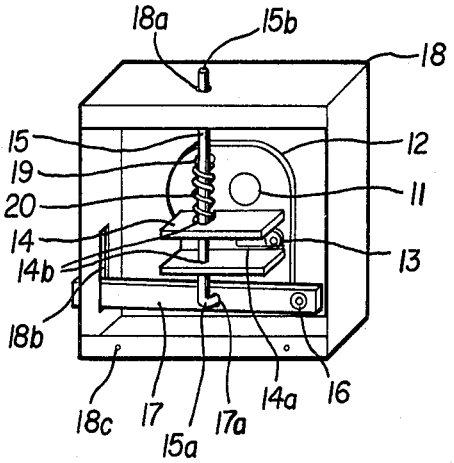
FIG. 3 is a back plan perspective view of a handle operating mechanism according to this invention.
Figure 5:
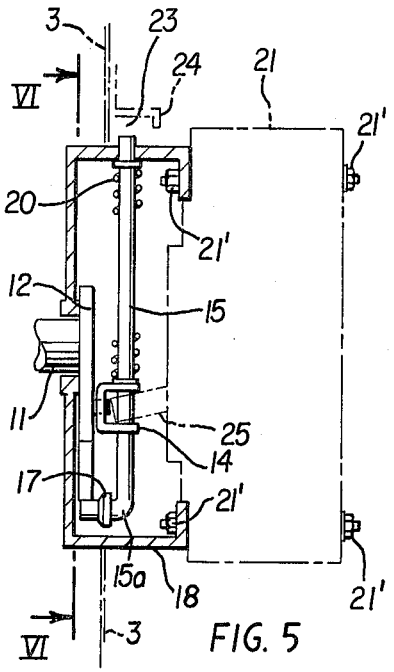
FIG. 5 is a side view, partly in vertical section, of the handle operating mechanism when the circuit breaker is positioned in the OFF state.

In FIGS. 2 and 3, which show a handle operating mechanism, a manually operable handle 10 is capable of rotation in a certain range of positions (e.g. RESET-OFF-TRIP-ON positions). The operable handle 10 is integrally coupled with a cam 12, having a pin 13, through an axle 11. By rotating the operable handle 10, the pin 13 which is mounted far from the axle 11 draws a relatively large arc. A sliding member 14, which engages with the pin 13, is engaged with an engaging mechanism or guide rod 15. The sliding member 14, as seen in FIG. 5, is formed with a U-shaped figuration and has elongated openings 14*a* in the bottom thereof in order to couple with the pin 13 of the cam 12, and two holes 14*b* which are located on opposite sides of U-shaped sliding members so as to permit the guide rod 15 to pass therethrough. The U-shaped configuration of the sliding member 14 serves to hold an operating lever 25 of the circuit breaker 21 which is mounted behind the case 18 through the screw hole 18*c* by a stud or welded bolt (not shown).

A bent end 15*a* of the guide rod 15 is engaged with a hole 17*a* which is provided in an intermediate portion of a release or operating lever 17, and the other end (top end) 15*b* extends from an opening 18*a* of a case 18. A biasing member, such as, stretching spring 20, is mounted along the axis of the guide rod 15 between the sliding member 14 and a stopping guide ring 19 mounted on the intermediate portion of the guide rod 15. Thus, the guide rod 15 is biased toward to the top end 15*b*.

One end of the release lever 17 is integrally coupled with a release pin 16 which is pivotally mounted on and extends from the surface of the case 18. An actuating mechanism, such as, a slot, a thumb screw, as shown in FIG. 2, is mounted on a head of the release pin 16 extended from the surface of the case 18 to rotate the pin 16 by a screwdriver (not shown) or similar mechanism. Another end of the release lever 17 passes through an elongated opening 18*b* formed in the case 18 and extends from the opening 18*b*.

Thus, the sliding member 14, adapted to be engaged with the operating lever of the circuit breaker, slides up and down along the guide rod 15 in response to movement of the pin 13 of the cam 12 coupled to the handle 10.

Figure 4:
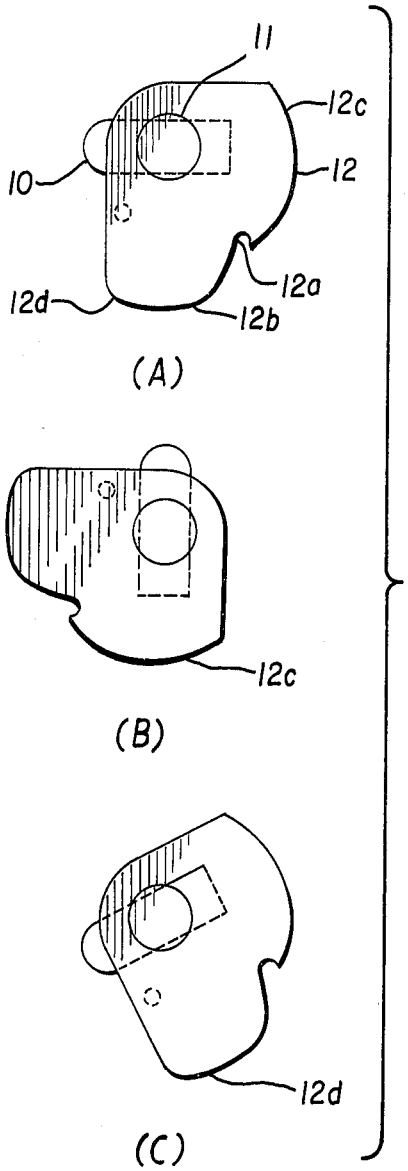
FIGS. 4A, 4B and 4C are schematic views, in front plan, indicating the rotating position of an operating handle and a cam integrally coupled therewith.

The construction of the cam 12, which serves to lock the rotation of the cam under certain conditions and to translate the rotational movement of the handle 10 to the reciprocating movement of the operating lever 17 of the circuit breaker, is now explained with reference to FIGS. 4A, 4B and 4C. As mentioned above, since the cam 12 is integrally coupled with the handle 10 through the axle 11, rotation of the cam 12 corresponds to the rotation of the handle 10. The cam 12, as seen in FIGS. 4A, 4B and 4C, is formed with a folding fan shaped figuration and with a trapped portion 12*a*, which is of a semicircular form, provided in the intermediate portion of the arc of the folding fan. The trapped portion 12*a* serves to lock the rotation of the handle 10 by engaging with the bent end 15*a* of the guide rod 15 when the door 3 is open in order to prevent an accident. For the purpose of later explanation, each position is designated by numerals 12*b*, 12*c* and 12*d* as shown in FIG. 4A.

In FIG. 4A, the handle 10 is positioned in the OFF position of the circuit breaker. In FIG. 4B, the handle 10 is positioned at the ON state and is rotated clockwise approximately ninety (90) degrees from the OFF position shown in FIG. 4A. Portion 12*c* of the cam 12 is then positioned at the lowest position. In FIG. 4C, the handle 10 is positioned at the RESET position of the circuit breaker, and is rotated counterclockwise approximately a few degrees from the OFF position shown in FIG. 4A. The portion 12*d* of the cam 12 is then located at the lowest position.

Referring now to FIG. 5, a molded case circuit breaker 21 having an operating lever 25 is mounted behind the case 18 of the handle operating mechanism by the use of bolts/nuts 21'. A stopping mechanism, or stopping member, 24 is mounted behind the door 3. The position of the stopping member 24 is such as to engage with the top end 15*b* of the guide rod 15 and to form a U-shaped groove between the stopping member 24 and the door 3.

The operation of the handle operating mechanism according to this invention is now explained with reference to FIGS. 2 through 13. In FIGS. 2 and 3, as described above, since the cam 12 is integrally coupled with the handle 10, rotation of the cam 12 corresponds to the rotation of the handle 10. The pin 13 of the cam 12 slides in the elongated opening 14*a* of the sliding member 14 in response to the arcuate movement of the pin 13 mounted on the cam 12 and thereby causes the sliding member 14 guided by the guide rod 15 to slide up and down. At that time, the guide rod 15 is biased toward the top end 15*b* and is moved toward the top end 15*b* by movement of the sliding member 14. However, since the bent end 15*b* of the guide rod 15 contacts with the cam 12, movement toward to the top end 15*b* of the guide rod 15 is restricted. Namely, when cam 12 is rotated clockwise from the position shown in FIG. 4A, the movement of the guide rod 15 corresponds to the arc configuration between positions 12*b* and 12*a*. Moreover, in the case where the cam 12 is rotated counterclockwise from the position shown in FIG. 4B or FIG. 4C, the movement of the guide rod 15 corresponds to the arcuate configuration between the positions 12*c* and 12*d* (ON position or RESET position) or the arcuate configuration between positions 12*b* and 12*d* (OFF position to RESET position).

In a similar manner, the extended end of the release lever 17 glides or is moved within the elongated opening 18*b* in response to the movement of the guide rod 15. Thus, by rotation of the handle 10 the cam 12, the guide rod 15 and the release lever 17 are actuated with the predetermined relationship, and the sliding member 14 is converted to linear movement following the rotation of the pin 13 mounted on the cam 12. Accordingly, the operating lever 25 of the circuit breaker 21, which is held by the sliding member 14, is actuated in ON-OFF operation.

Figure 6:
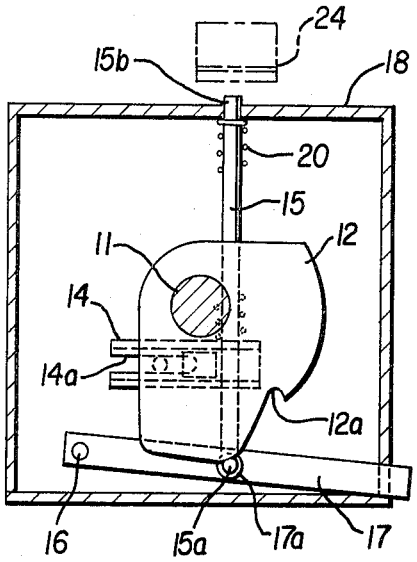
FIG. 6 shows a section of the handle operating mechanism taken along the line VI—VI of FIG. 5.

Referring to FIG. 6, the operation lever 25 of the circuit breaker 21 is positined at the OFF position as indicated in FIGS. 2 and 4A. At this time, the bent end 15*a* of the guide rod 15 contacts with position 12*b* of the cam 12 as shown in FIG. 4A.

Figure 7:
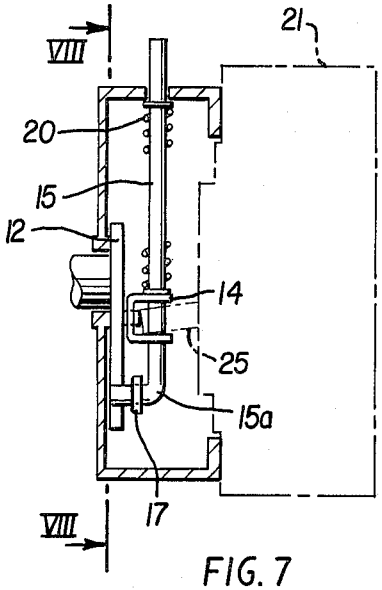
FIG. 7 is a side view, partly in vertical section, of the handle operating mechanism in the case where an attempt is made to turn the handle so as to turn on the circuit breaker when the door of a casing, which is provided with the circuit breaker, is open.
Figure 8:
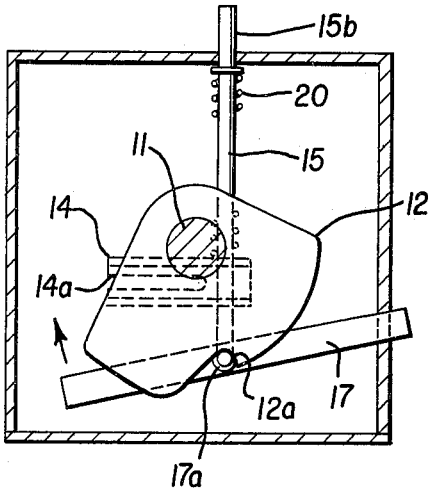
FIG. 8 shows a sectional view of the handle operating mechanism taken along the line VIII—VIII of FIG. 7.

Referring now to FIGS. 7 and 8, the operation of the handle operating mechanism where the door 3 is opened is explained. Under this condition, if the handle 10 is rotated clockwise to turn the circuit breaker to its ON position, since the guide rod 15 is continuously biased by the spring 20 in an upward direction in FIGS. 7 and 8, the bent end 15*a* is trapped in the trapped portion 12*a* of the cam 12 following rotation of the cam 12. After that, the handle 10 (and cam 12) cannot rotate. Accordingly, in case the door 3 is open, the ON operation of the circuit breaker 21 is locked.

Figure 9:
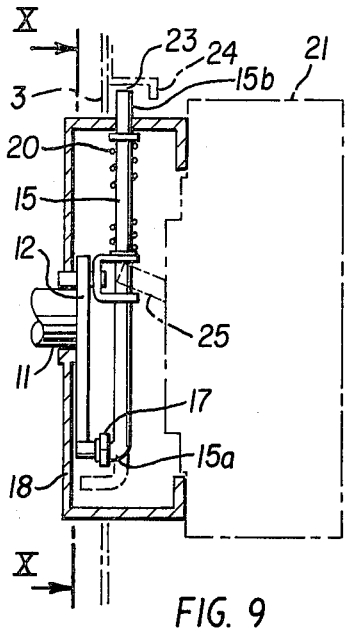
FIG. 9 is a side view, partly in vertical section, of the handle operating mechanism when the circuit breaker is positioned in the ON state.
Figure 10:
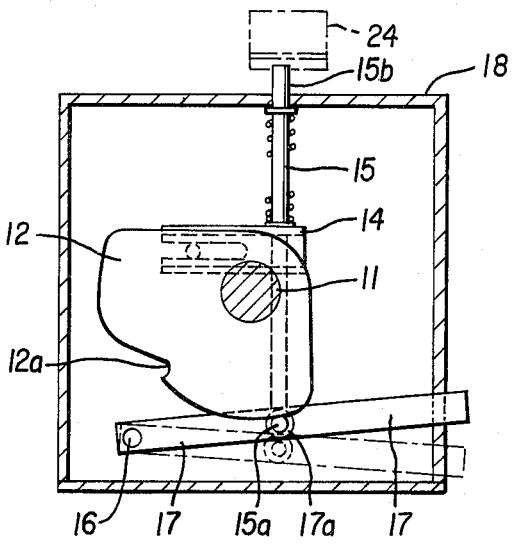
FIG. 10 is a sectional view of the handle operating mechanism taken along the line X—X of FIG. 9.

Referring now to FIGS. 9 and 10, the operation of the handle operating mechanism when the handle is rotated clockwise in the case where the door 3 is closed is explained. In this case, since the stopping member 24 mounted on the door 3 is provided so as to contact with the top end 15*b* of the guide rod 15, the guide rod 15 can move only to the position determined by the stopping member 24, even though the guide rod 15 is biased by the spring 20.

Therefore, even though the cam 12 is rotated clockwise, the cam 12 (and the handle 10) can rotate without trapping the bent end 15*a* in the trapped portion 12*a* of the cam 12. As discussed above, by rotating the handle 10 about ninety (90) degrees to the position as shown in FIGS. 4B, 9 or 10, the circuit breaker 21 is turned ON. That is, in case the door 3 is closed, the operation of turning on the circuit breaker is permitted.

Moreover, in this position, since the top end 15*b* of the guide rod 15 is positioned at the U-shaped groove 23 formed by cooperation between the door 3 and the stopping member 24, it is impossible to open the door 3. That is, in the case where the circuit breaker 21 is turned on, the door 3 is locked.

There are, however, some instances wherein opening of the door 3 is required when the circuit breaker 21 is turned on because of a circuit breaker accident or similar reason. In such case, if the pin 16 of the release lever 17 is rotated clockwise by a screwdriver (not shown), the guide rod 15 is moved downwardly so as to disengage with the trapped portion 12*a* of the cam 12. Of course, it is possible to optionally provide pin 16 for releasing the locking condition. In addition, if the release lever 17 is not provided, it is preferable to support the end of the guide rod 15 by suitable supporting means to prevent instability of the guide rod 15.

Figure 11:
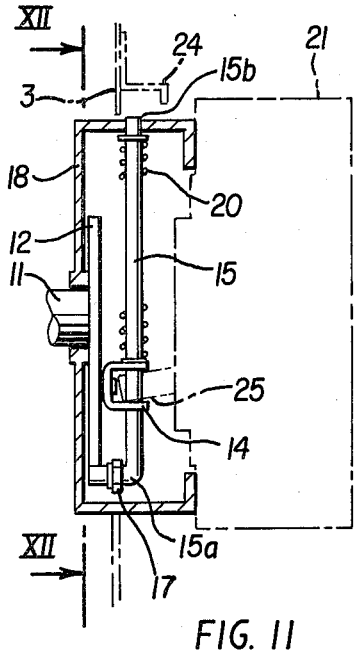
FIG. 11 is a side view, partly in vertical section, of the handle operating mechanism when the circuit breaker is positioned in the TRIP state.
Figure 12:
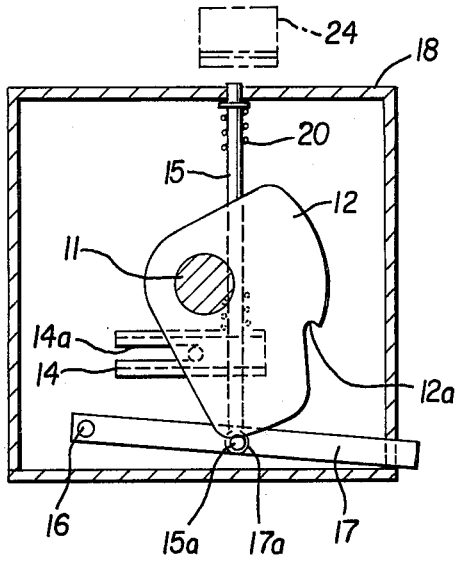
FIG. 12 shows a sectional view of the handle operating mechanism taken along the line XII—XII of FIG. 11.

Referring now to FIGS. 11 and 12, the operation of resetting the circuit breaker is explained. It, as well known, is necessary to reset the circuit breaker when the circuit breaker is tripped due to overloading, shorting of circuit, etc. In general, the reset operation has to actuate the operating lever 25 of the circuit breaker 21 in the OFF position, i.e. to rotate the handle 10 counterclockwise from the TRIP position to the RESET position shown in FIGS. 2. When the handle 10 is rotated counterclockwise from the TRIP position to the RESET position as shown in FIG. 4C, since the sliding member 14 is moved downwardly and at the same time the operating lever 25 of the circuit breaker 21 is depressed to the OFF position, it is possible to reset the circuit breaker 21.

Furthermore, there is a case where the circuit breaker is placed or mounted at the position rotated about nintey (90) degrees, i.e. from the vertical setting to the horizontal setting.

Figure 13:
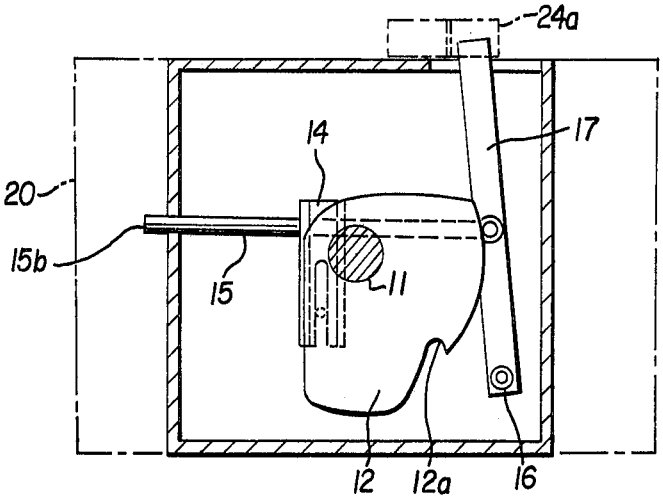
FIGS. 13 and 14 show modifications of the handle operating mechanism of the present invention.

Referring now to FIG. 13, the top end 15*b* of the guide rod 15 extends from the left side of the case 18. On the other hand, the extended end of the release lever 17 is positioned at the upper side of the case 18 and is moved left and right in response to the movement of the guide rod 15. Therefore, a stopping member 24*a*, which corresponds to the stopping member 24, is mounted on the door 3 to engage or interlock with the extended end of the release lever 17 when the door is closed. Of course, it is constructed so as to release the bent end 15*a* of the guide rod 15 from the trapped portion 12*a* when the door 3 is closed. Thus, it is possible to optionally set the circuit breaker or the handle operating mechanism at both the horizontal or vertical setting because both settings can be locked.

Figure 14:
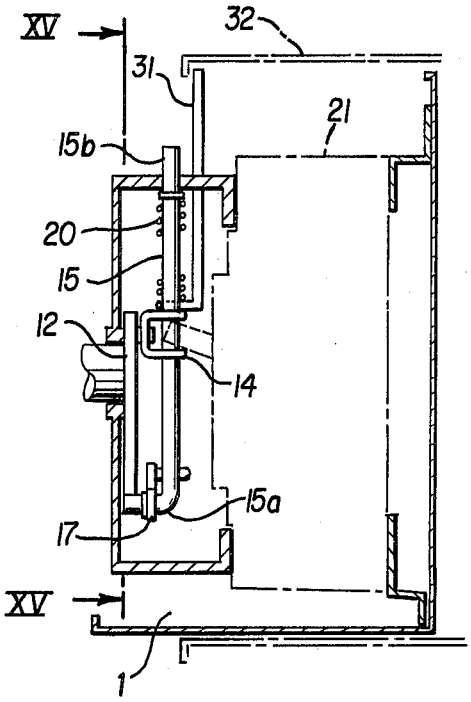
Figure 15:
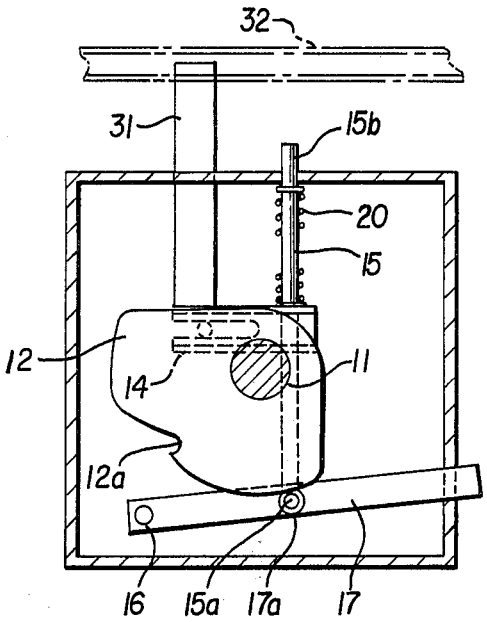
FIG. 15 shows a sectional view of the handle operating mechanism taken along the line XV—XV of FIG. 14.

Referring now to FIGS. 14 and 15, a modification of this invention, which ensures contact between the unit device and the bar, etc. to be connected to the unit device and locking between the unit device and the casing, is explained hereinbelow.

In the control center as shown in FIG. 1, the unit device 1 is generally automatically connected with the bus bar and other line by setting or accommodating the unit device 1 into the casing 2. An additional engaging mechanism, such as an L-shaped locking member 31 is mounted on the sliding member 14 and a part of it extends from the case 18. On the other hand, a partition member 32 is mounted on the casing 2 to engage with the extended locking member 31. If any attempt is made to set or accommodate the unit device 1 having the circuit breaker in the casing 2 when the circuit breaker is turned on for some reason, since the locking member 31 conflicts with the partition member 32, it is impossible to so set or accommodate the unit device 1 in the casing 2.

Furthermore, when the circuit breaker is turned on and an attempt is made to pull or draw out the unit device 1 from the casing, it is impossible to pull or draw out the unit device because of the interlocking relationship between the locking member 31 and the partition member 32. Therefore, there is no danger that the unit device can be pulled out during supplying of electric power.

Figure 16:
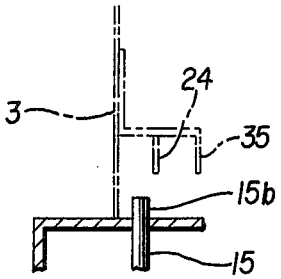
FIGS. 16 and 17 respectively show modifications of the interlocking of the handle operating mechanism.

Referring now to FIG. 16, a modification of this invention, which is capable of the interlocking at the testing position of the unit device, is explained hereinbelow. In general, the unit device 1 can be positioned at the connection, the disconnection and the testing position in the casing 2 of the control center. That is, the connection position mechanism completes the connection between the unit device 1 and the casing 18, the disconnecting position allows the unit device 1 to be drawn out from the casing and be disconnected, and the testing position allows for operation of a signal control circuit for connecting the circuit breaker to indicate the condition thereof and which is connected to the unit device 1. However, the circuit breaker 21 is not connected with the bus bar because of checking of the circuit breaker and other instruments. Considering the disconnection position of the unit device 1, interlocking between the circuit breaker 21 and the casing 2 usually does not occur. But, interlocking is required between them at both the connection and the testing positions because circuits in the casing 2 are energized from a main power source and an auxiliary power source for controlling the circuit for safety.

For the purpose of providing two interlocking functions described above, an additional stopping member 35 is mounted on the stopping member 24. When the unit device 1 is placed in the testing position, interlocking occurs between the top end 15*b* of the guide rod 15 and the groove formed by the door 3 and the stopping member 24. When the unit device 1 is placed in the connection position as described hereinabove, interlocking occurs between the top end 15*b* and the groove formed by the stopping member 24 and the additional stopping member 35.

Figure 17:
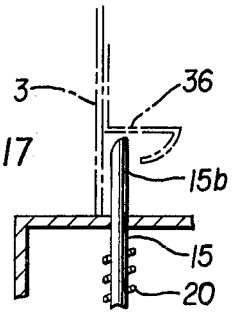

Referring now to FIG. 17, a further modification of this invention is explained hereinbelow. In the case where the pin 16 for releasing the guide rod 15 is started clockwise, as discussed above, and the door is then opened while the circuit breaker in the unit device 1 is turned on, it is impossible to close the door 3 because the top end 15*b* engages with the stopping member 24. Thus, as shown in FIG. 17, a semicircular stopping member 36 is mounted behind the door 3 instead of the stopping member 24 shown in FIGS. 5 and 6. Moreover, the top end 15*b* is formed as with a semicircular figuration so as to face the stopping member 36 when the door is closed. Thus, when the door 3 is moved, both semicircular members slide with each other and the guide rod 15 is depressed downwardly. After the door 3 is completely closed, the guide rod 15 is returned by the spring 20 without releasing operation of the pin 16 whereby interlocking occurs.

It should now be apparent that, in accordance with the teachings of this invention, the advantages thereof are as follows:

(1) It is easy to adjust the interlocking mechanism without the influence of the warping, bending etc. of the door because the interlocking mechanism is not directly actuated by depressing the door, as in the prior art.

(2) It is easy to optionally attach or mount the handle operating mechanism on the unit device because the interlocking mechanism is engaged in two directions, i.e. the vertical or the horizontal settings; and (3) No careless throw-in operation of the circuit breaker occurs because the interlock mechanism is constructed so as to prevent the unit device from being set or accommodated within the casing when the circuit breaker is turned on.

Obviously, many modifications and variations of this invention are possible in light of the above teachings. It is therefore to be understood that within the scope of the appended claims, the invention may be practiced otherwise than an specifically described herein.

What is claimed as new and desired to be secured by Letters Patent of the United States is:

1. A handle operating mechanism in combination with an electric circuit breaker having an operating lever which interlocks the electric circuit breaker and a door of a casing accommodating the circuit breaker, said combination comprising:

a case disposed within the casing;

a release lever for the circuit breaker mounted within the case;

a manually operable handle rotatably mounted on a surface of the case for predetermined operating positions including an ON position and TRIP position;

means connected to the operable handle for actuating the release lever for the circuit breaker upon movement of the operable handle; and means for engaging the case with the door of the casing so as to interlock the case and the door when the operable handle is placed at the ON and TRIP positions;

said actuating means further comprising a sliding member engaging the engaging means so as to slide along the engaging means in response to movement of the operable handle.

2. A handle operating mechanism as set forth in claim 1, said engaging means comprising first and second engaging members cooperating so as to engage the case with the door of the casing, said actuating means lockably engaging the engaging means when the door of the casing is opened.

3. A handle operating mechanism as set forth in claim 2, wherein said first and second engaging members are interconnected.

4. A handle operating mechanism as set forth in claim 2, further comprising means disposed within the case for biasing one of said first and second engaging members and for actuating the release lever for the circuit breaker.

5. A handle operating mechanism as set forth in claim 2, wherein the case includes a hole formed therein and one of said first and second engaging members comprises a bent portion and a top end portion which extends from the case, respectively, and the release lever cooperatively engages the hole in the case and further includes a hole formed therein to pivotably engage with the bent portion of said one of said first and second engaging members, the top end portion being movable in accordance with movement of said bent portion.

6. A handle operating mechanism as set forth in claim 5, further comprising releasing means for releasing engagement between the bent portion of said one of said first and second engaging members and the actuating means.

7. A handle operating mechanism in combination with an electric circuit breaker having an operating lever which interlocks the electric circuit breaker and a door of a casing accommodating the circuit breaker, said combination comprising:

a case disposed within the casing;

a release lever for the circuit breaker mounted case;

a manually operable handle rotatably mounted on a surface of the case for predetermined operating positions including an ON position and TRIP position;

means connected to the operable handle for actuating the release lever for the circuit breaker upon movement of the operable handle; and means for engaging the case with the door of the casing so as to interlock the case and the door when the handle is placed at the ON or TRIP positions, said actuating means lockably engaging the engaging means when the door of the casing is opened, said actuating means further comprising a sliding member engaging the engaging means so as to slide along the engaging means in response to movement of the operable handle.

8. A handle operating mechanism as set forth in claims 1 or 7, further comprising stopping means mounted on the door of the casing for stopping movement of the engaging means to allow for rotation of the operable handle.

9. A handle operating mechanism as set forth in claim 8, the stopping means including two portions corresponding to connecting and testing positions of the circuit breaker, respectively.

10. A handle operating mechanism as set forth in claim 8, the stopping means being formed with a hook-shape on the door with the top end portion of the engaging means being formed in a semicircular shape whereby the door can close even if the circuit breaker is positioned at the ON or TRIP position.

11. A handle operating mechanism which actuates an electric circuit breaker having an operating lever which interlocks the electric circuit breaker and a door of a casing accommodating the circuit breaker, said mechanism comprising:

a case for disposition within the casing;

a release lever for the circuit breaker mounted within the case;

a manually operable handle rotatably mounted on a surface of the case for predetermined operating positions including an ON position and TRIP position;

means connected to the operable handle for actuating the release lever for the circuit breaker upon movement of the operable handle; and means for engaging the case with the door of the casing so as to interlock the case and the door when the operable handle is placed at the ON and TRIP positions, said actuating means comprising an operating axle integrally coupled with the manually operable handle, a cam having a trapped portion integrally coupled with the operating axle, and a sliding member for operating the release lever for the circuit breaker in response to movement of the cam.

12. A handle operating mechanism as set forth in claim 11, further comprising means disposed within the case for biasing said engaging means and for actuating the release lever, said sliding member having an opening formed therein within which the engaging means is disposed.

13. A handle operating mechanism as set forth in claim 11, further comprising additional engaging means mounted on the sliding member of the actuating means and extending through the case, and a partition member mounted on the casing for preventing movement of the case.

14. A handle operating mehcanism in combination with an electric circuit breaker having an operating lever which interlocks the electric circuit breaker and a door of a casing accommodating the circuit breaker, said combination comprising:

a case disposed within the casing;

a release lever for the circuit breaker mounted within the case;

a manualy operable handle rotatably mounted on a surface of the case for predetermined operating positions including an ON position and TRIP position;

means connected to the operable handle for actuating the release lever for the circuit breaker upon movement of the operable handle; and means for engaging the case with the door of the casing so as to interlock the case and the door when the handle is placed at the ON or TRIP positions, said actuating means lockably engaging the engaging means when the door of the casing is opened, said actuating means comprising an operating axle integrally coupled with the manually operable handle, a cam having a trapped portion integrally coupled with the operating axle, and a sliding member for operating the release lever for the circuit breaker in response to movement of the cam.

* * * * *